United States Patent [19]

Murphy

[11] Patent Number: 5,050,254

[45] Date of Patent: Sep. 24, 1991

[54] PATIENT EVACUATION ENVELOPE

[76] Inventor: Wendy J. Murphy, 48 Southvale Drive, Toronto, Ontario, Canada, M4G 1G3

[21] Appl. No.: 530,193

[22] Filed: May 29, 1990

[51] Int. Cl.[5] ..... A61G 1/00; A61G 1/044; A61G 1/048

[52] U.S. Cl. ..... 5/82 R; 5/413

[58] Field of Search ..... 5/82 R, 82 B, 413; 128/872, 873, 869

[56] References Cited

U.S. PATENT DOCUMENTS

| | | | |
|---|---|---|---|
| 1,315,294 | 9/1919 | Fink et al. | 5/413 |
| 3,601,824 | 8/1971 | Bradford | 5/82 R |
| 3,695,507 | 10/1972 | Sams | 5/413 |
| 3,829,914 | 8/1974 | Treat | 5/82 R |
| 4,601,076 | 7/1986 | Knobeloch | 5/413 |
| 4,627,428 | 12/1986 | Brooks | 5/82 R |

FOREIGN PATENT DOCUMENTS

| | | | |
|---|---|---|---|
| 2418374 | 6/1976 | Fed. Rep. of Germany . | |
| 89/09039 | 10/1989 | PCT Int'l Appl. | 5/82 R |
| 1536191 | 12/1978 | United Kingdom | 5/82 R |

*Primary Examiner*—Alexander Grosz

*Attorney, Agent, or Firm*—Fetherstonhaugh & Co.

[57] ABSTRACT

An evacuation sheet as provided in the form of a longitudinally elongated web as can be folded along a fold line that extends transversely of the width thereof to form an envelope. Binding straps are provided which serve to secure the two lengths of the web in the face to face relationship and handles are provided which facilitate the lifting of the envelope. A first portion of the web is inserted lengthwise under a bedridden patient and then the second length is folded over the first length and secured in the face to face relationship by means of the binding straps. The patients can then be lifted from the bed using the lifting handles. Handles are also provided at the end remote from the closed end of the envelope which can be used for the purposes of lowering the patient down an incline.

13 Claims, 4 Drawing Sheets

PATIENT EVACUATION ENVELOPE

BACKGROUND OF INVENTION

This invention relates to evacuation devices for evacuating bedridden patients from a hospital or the like.

In the event of an emergency in a hospital or the like, when it is necessary to evacuate bedridden patients, considerable difficulty has been experienced in removing the bedridden patients from a floor of a hospital which is to be evacuated. Generally, it requires at least two members of the hospital staff to lift a bedridden patient from a bed and to position the patient on a rescue stretcher. Because of the large number of rescue stretchers which would be required to evacuate many hospitals, the cost involved in maintaining a stretcher for each bed would be exceedingly high.

U.K. Patent No. 1,536,191 discloses a rescue bag which can be used to rescue an injured or unconscious person. The rescue bag includes a base portion and a cover portion connected together by suitable slide fasteners. In one embodiment, the cover is attached to the base along a short portion of the side edge thereof. In another embodiment, the cover and base portion are split lengthwise from the lower end thereof. A securing harness is provided on the base portion which is used for the purposes of securing a patient thereon.. This structure is a complex structure and it is not well suited for use in attempting to evacuate a bedridden patient because it is not designed to facilitate the sliding of the base portion under a patient that is lying on a bed.

German Patent No. 2,418,374 which issued to Manfred Kufahl. This patent discloses a structure in which a blanket is attached to a stretcher by straps that connect an edge of the blanket to the stretcher. The blanket is fitted with harness straps which serve to secure the patient with respect to the assembled blanket and stretcher.

SUMMARY OF INVENTION

It is an object of the present invention to provide a simple and inexpensive evacuation sheet which is adapted to form an evacuation envelope for use when evacuating bedridden patients from a hospital bed or the like.

It is a further object of the present invention to provide an evacuation sheet which can be stored in a compact-coiled configuration.

It is yet another object of the present invention to provide an evacuation sheet which will slide easily underneath a bedridden patient.

It is a still further object of the present invention to provide an evacuation sheet which is longitudinally elongated and can be folded upon itself to form a closed end of an evacuation envelope surrounding a patient in use.

It is a still further objection of the present invention to provide binding straps that serve to secure the overlying portion of the evacuation envelope with respect to the underlying portion to form a body-accommodating evacuation envelope.

According to a still further aspect of the present invention, there is provided an evacuation sheet which has a length which is equal about twice the height of the patient to be evacuated thereby.

According to one aspect of the present invention, there is provided an evacuation sheet adapted to form an evacuation envelope for use when evacuating bedridden patients from a hospital bed or the like comprising; a web of flexible material having; a first end, a second end and a longitudinally elongated body extending therebetween, and a pair of oppositely disposed side edges and a width extending between the side edges, a first portion of said web extends inwardly from the first end and a second portion extends inwardly from the second end, the first and second portions each having a length that is about equal to the height of the patient that is to be accommodated therebetween in use, said web being foldable across the width thereof to locate the first portion in an overlying relationship with respect to the first portion to form an evacuation envelope that is proportioned to accommodate the body of the patient and which is closed at one end, binding means for releasably connecting the side edges of the first and second portions of the web to retain said first portion in said overlying relationship, and handle means attached to the first portion to permit the envelope to be lifted to carry a patient therein.

BRIEF DESCRIPTION OF THE DRAWINGS

With reference to FIG. 1 of the drawings, the reference numeral 10 refers generally to an evacuation sheet constructed in accordance with the embodiment of the present invention which is suitable for use in forming the evacuation envelope which is illustrated in FIG. 2 of the drawings and is generally identified by the reference numeral 20. The evacuation sheet 10 consists of a web 12 which is made from a sheet of fire retardant fabric. A suitable material for this purpose is available from Bruin Plastics Company Inc. and is identified by the Trade-mark ES100. This material is a laminate which consists of a backing web of vinyl and a polyester film such as Mylar (TM), the polyester film being impregnated with aluminum. The metalized inner face of the fabric acts as a heat reflector that serves to reflect body heat back to the patient and this serves to reduce the rate at which the patient loses body heat.

Figure 1:
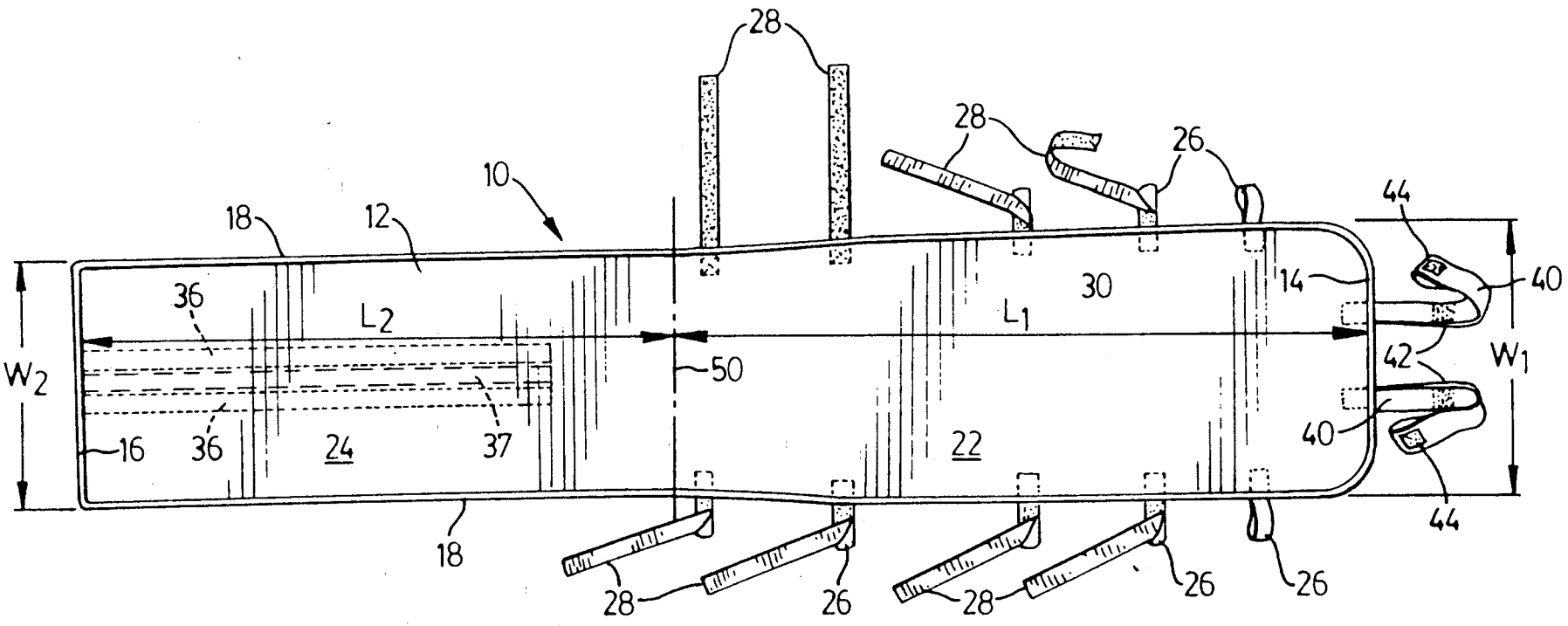
FIG. 1 is a plan view of an evacuation sheet constructed in accordance with an embodiment of the present invention.

The web 12 has a first end 14, a second end 16 and a pair of oppositely disposed side edges 18. The web 12 has a first portion 22 which extends from the first end 14 to about the centre of the length of the web. The first portion has a length L1. The second portion 24 extends inwardly from the second end 16 and has a length L2. The overall length of the web (L1 plus L2) is about equal to twice the height of the patient that is to be accommodated therebetween in use usually about 12 ft. Generally, however, the overall length will be selected so that the length L1 is about the length of the average hospital bed. The length of the second portion L2 is generally somewhat less than that of the first portion L1.

The width W1 of the first portion 22 is preferably about 29 inches and is slightly greater than the width W2 of the second portion.

Figure 3:
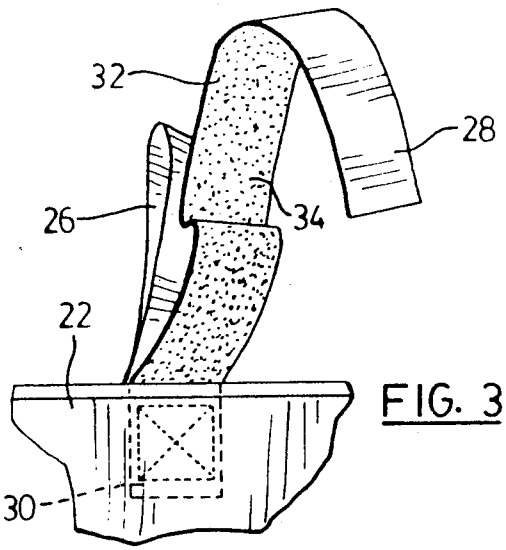
FIG. 3 is an enlarged detail showing the manner in which the handles and binding straps are attached to the evacuation sheet. /
Figure 5:
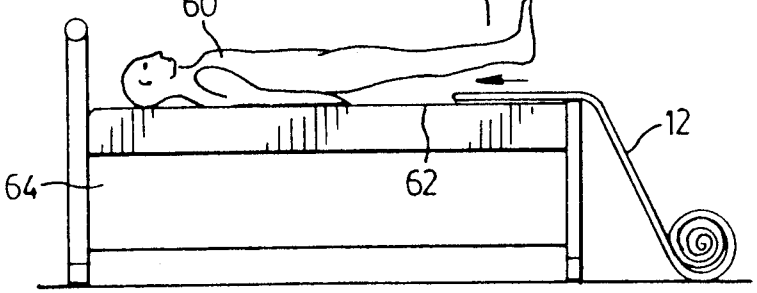
FIG. 5 is a diagram illustrating the manner in which the sheet may be caused to pass under a bedridden patient.

A plurality of side handles 26 are attached by sewing or the like to the first portion 22 at spaced intervals along the length thereof. As shown in FIG. 3, each handle 26 is in the form of a strap which is folded to form a loop.

A plurality of binding straps 28 are also attached to the first portion 22 at spaced intervals along the length thereof; and as shown in FIG. 3, the binding straps 28 are attached to the first portion 22 by the same stitching 30 that is used to attach the handles 26. The straps 28 have a face 32 on which the loops or hooks of a fabric fastener such as one of the elements of a "Velcro" (TM) fastener is provided.

Figure 2:
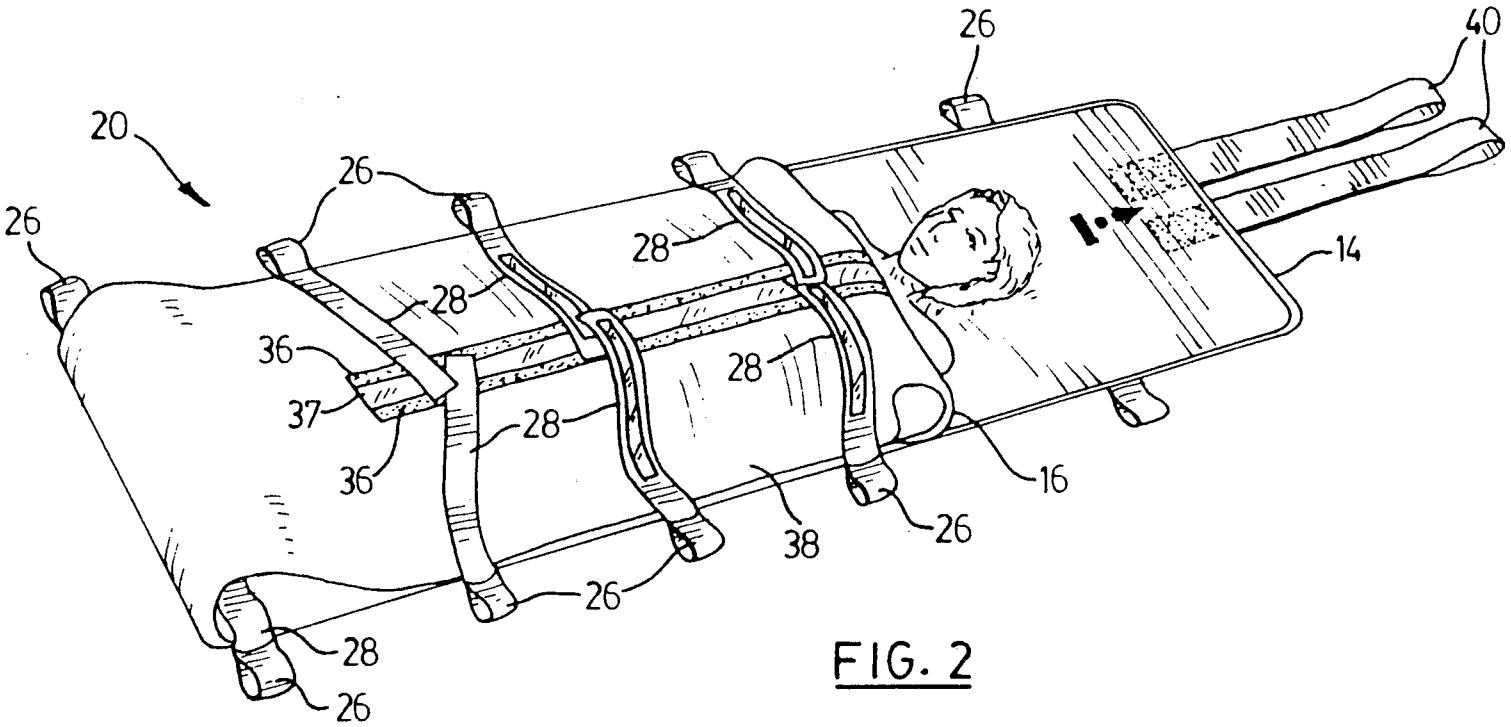
FIG. 2 is a pictorial view of the evacuation sheet of FIG. 1 in a folded configuration.

Bands 36 of a complimentary fastener material to that of the binding straps 28 are attached to the back face 38 (FIG. 2) of the second portion 24 and extend longitudinally inwardly from the second end 16 in a spaced parallel relationship. A band 37 of a light reflective material is attached to the back face 38 and extends along the full length thereof. The band 37 helps to make the envelope visible to a rescue crew using flashlights for searching in a dark environment.

A pair of front handles 40 are attached to the first portion 22 and extend outwardly from the end 14. The handles 40 are attached in a like manner to that described and illustrated with respect to the handles 26. The handles 40 are of a similar construction to the handles 26 except that they have a greater length. Preferably the extended length of the handles 40 from the end 14 is about three feet. By comparison the handles 26 extend about six inches from the side edges 18.

Each handle 40 has fastener patches 42 and 44 applied thereto. These fastener patches serve to retain the sheet in the coiled configuration shown in FIG. 4 with the result that the front handles 40 perform the dual function of providing a lifting handle and a binding strap for retaining the web in a compact storage coil.

Figure 4:
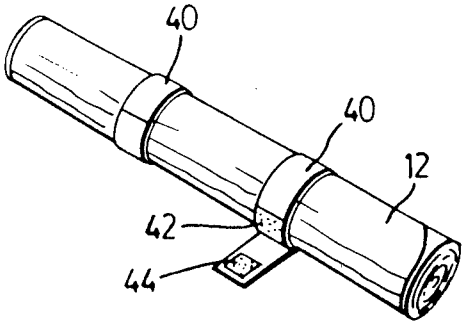
FIG. 4 is a pictorial view illustrating the manner in which the sheet may be formed into a coil to provide a compact storage configuration.

When the evacuation sheet is not in use, it is rolled up from the second end 16 to form a tightly wound coil and the front handles 40 are wound around the coil and the fastener patch 44 is secured to the fastener patch 42 to retain the straps in a position and circling the coil as shown in FIG. 4. It will be apparent that this provides a very compact form in which the evacuation sheet of the present invention may be stored. It is so compact that it can be stored at the foot of a hospital bed or underneath a hospital bed. When tightly wound the coil may have a diameter of about four inches. Clearly, it is much easier to store this size of item than it is to store a rigid stretcher. The total weight of a typical evacuation sheet is about 5.2 lbs.

In use, the straps 40 are released from the position in which they encircle the coil so that the coil is free to unwind. The sheet is then located at the foot of a bed and allowed to unwind as the leading end 14 is slipped under the bottom sheet on which the patient 60 is resting and slides along the top of the mattress 62 between the bottom sheet and the mattress 62 of the bed 64. As previously indicated, the web 12 is preferably made from a plastics material which has a low coefficient of friction with the result that it is possible to slide the web 12 over the mattress 62 or a bedsheet located thereon with ease.

Figure 6:
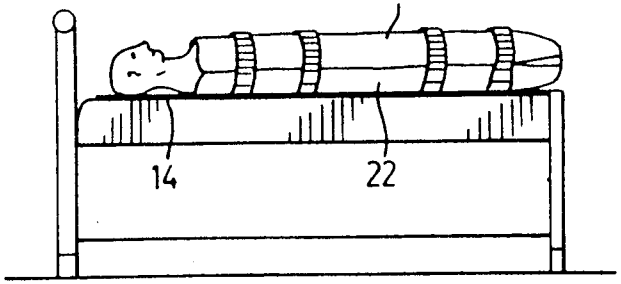
FIG. 6 shows the evacuation sheet in an assembled configuration.

When the first section 22 has been fully deployed so that it extends to the position shown in FIG. 6 in which the patient is fully accommodated on the first portion 22, the sheet is then folded along a line that the fold line 50, or a fold line that extends parallel thereto, to locate the second portion 24 in an overlying face to face relationship with respect to the first portion 22. In the arrangement shown in FIG. 2 the sheet is folded adjacent the first pair of handles 26 and the end 16 is folded inwardly across the width thereof. The binding straps 28 then drawn inwardly and are fastened to the bands 36 to secure the second portion 24 in a face to face relationship. Thus, it will be seen that an envelope 20 is formed which is open between the ends 14 and 16 and is closed along the fold line 50 which forms the other end of the envelope. The sides of the envelope are effectively closed by the binding straps 28 with the result that the patient ca be accommodated within the compartment formed within the envelope.

Figure 7:
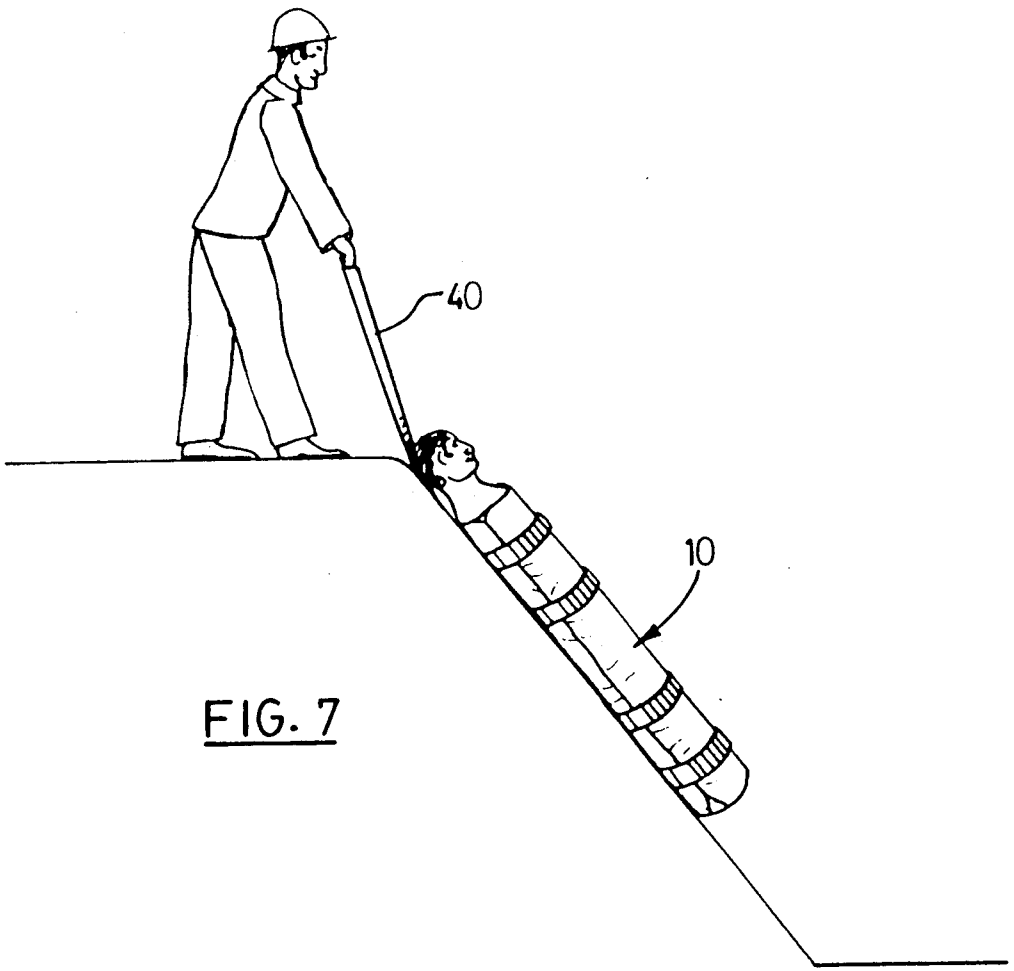
FIG. 7 illustrates the manner in which the evacuation envelope may be used.

The patient can then be lifted out of the bed by manually engaging the handles 26. Once the patient has been removed from the bed using two or more rescue staff, the envelope 20 can be lowered on to the floor and front handle 40 may be manually engaged to permit the envelope to be dragged along the floor by a single member of the rescue staff to an evacuation site or to a stairwell. Because the end of the envelope 52 is closed, it is possible to lower the patient down a slide as shown in FIG. 7 by simply grasping the long front handles 40.

It will be apparent from the foregoing that the evacuation sheet of the present invention is relatively inexpensive to manufacture; and consequently, it may be possible to provide a separate evacuation sheet for each of the hospital beds likely to be occupied by bedridden patients. In addition, because the evacuation sheet of the present invention is simple to use, practice drills can be carried out from time to time without disrupting the day to day operation of the hospital.

Various modifications of the present invention will be apparent to those skilled in the art. For example, an alternative type of fastener may be used to connect the binding straps to the second portion. It should be understood, however, that the binding system of the present invention is particularly desirable because it permits the binding straps to be applied to the binding bands merely by pressing one on top of the other.

These and other advantages of the present invention will be apparent to those skilled in the art.

I claim:

1. An evacuation sheet adapted to form an evacuation envelope for use when evacuating bedridden patients from a hospital bed or the like comprising:

(a) a thin web of flexible fire-retardant material of generally uniform thickness, having; a first end, a second end and a longitudinally elongated body extending therebetween, and a pair of oppositely disposed side edges and a width extending between the side edges, said thin web being sufficiently flexible to permit it to assume a compact storage configuration, (b) a first portion of said web extending inwardly from the first end and a second portion extending inwardly from the second end, the first and second portions each having a length that is about to the height of the patient that is to be accommodated therebetween in use, said web being foldable across the width thereof to locate the second portion in an overlying relationship with respect to the first portion to form an evacuation envelope that is proportioned to accommodate the body of the patient and which is closed at one end, (c) binding means for releasably connecting the side edges of the first and second portions of the web to retain said second portion in said overlying relationship, and (d) lifting handle means attached to the said edges of the first portion and located at adjacent opposite ends and at about the middle of the length of the side edges of the first portion to permit the envelope to be lifted to carry a patient therein.

2. An evacuation sheet as claimed in claim 1, wherein the handle means further comprises at least one front handle at the first end of the web for use when lowering the evacuation sheet with the closed end lower than the first end.

3. An evacuation sheet as claimed in claim 2, wherein the front handle means comprises a pair of flexible straps that are folded to form manually engagable loops, the flexible straps having a substantial length so as to facilitate the lowering of the evacuation envelope from the first end down an incline.

4. An evacuation sheet as claimed in claim 3, wherein the front handle straps have a sufficient length to extend about three feet from said front end.

5. An evacuation sheet as claimed in claim 2, wherein said front handle means as adapted to function as a binding strap that serves to retain the web in the compact storage configuration.

6. An evacuation sheet as claimed in claim 1, wherein the binding means comprises a plurality of belts that are attached to the first portion of the web and extend outwardly from the side edges of the first portion of the web and at least one attachment band located on the outer face and extending longitudinally of the second portion, the belts and band having interlocking hook and loop fasteners arranged thereon to permit the belts to be releasably secured with respect to the attachment band.

7. An evacuation sheet as claimed in claim 6, wherein two attachment bands are located on the second portion in a side by side relationship.

8. An evacuation sheet as claimed in claim 1, wherein the web of flexible fire-retardant material has a heat reflective upper surface.

9. An evacuation sheet as claimed in claim 1, wherein the width of the second portion is less than that of the first portion whereby the side edges of the first portion from which the handle means project are readily accessible when the second portion is located in the overlying relationship as aforesaid.

10. An evacuation sheet as claimed in claim 1, wherein the handle means comprises a plurality of belts that are folded to form handle loops, the handle loops being located at a plurality of longitudinally spaced intervals along the length of each side edge.

11. An evacuation sheet as claimed in claim 10, wherein the handle loops at one side edge are aligned with the handle loops at the other side of the first portion to permit symmetrical lifting of the envelope in use.

12. An evacuation sheet as claimed in claim 1, wherein the upper and lower faces of the flexible material are each made from a material that has a low coefficient of friction so as to readily slide under a sheet of a bed to facilitate the movement of the first portion under the bedsheet of a bedridden patient in use.

13. An evacuation sheet as claimed in claim 1, wherein the web is sufficiently flexible to permit it to be rolled up from one end thereof to the other to provide a compact storage coil configuration.

* * * * *